US009265695B1

(12) United States Patent
Fralick

(10) Patent No.: US 9,265,695 B1
(45) Date of Patent: Feb. 23, 2016

(54) MEDICATION RECORDING DEVICE

(71) Applicant: James Fralick, Antelope, CA (US)

(72) Inventor: James Fralick, Antelope, CA (US)

( * ) Notice: Subject to any disclaimer, the term of this patent is extended or adjusted under 35 U.S.C. 154(b) by 313 days.

(21) Appl. No.: 13/924,848

(22) Filed: Jun. 24, 2013

Related U.S. Application Data

(60) Provisional application No. 61/663,740, filed on Jun. 25, 2012.

(51) Int. Cl.
*A61J 7/04* (2006.01)
*G09F 11/00* (2006.01)
*A61J 1/00* (2006.01)

(52) U.S. Cl.
CPC ..... *A61J 1/00* (2013.01); *A61J 7/04* (2013.01)

(58) Field of Classification Search
CPC ..... A61J 7/04; G09F 9/00; G09F 9/40; G09F 11/00; G09F 11/02
USPC ..... 116/304, 308, 309, 311, 312, 313, 314, 116/315, 316, 317, 318, 319, 320; 206/459.1, 534, 459.5; 215/230
See application file for complete search history.

(56) References Cited

U.S. PATENT DOCUMENTS

| | | | | |
|---|---|---|---|---|
| 332,208 | A | 12/1885 | Noel | |
| 1,761,947 | A * | 6/1930 | Wedin | 116/304 |
| 1,912,418 | A | 6/1933 | Mccreary | |
| 1,992,028 | A | 2/1935 | Harper | |
| 2,945,312 | A * | 7/1960 | Book | 40/503 |
| 3,747,246 | A * | 7/1973 | Sarier et al. | 40/518 |
| 3,911,856 | A | 10/1975 | Ewing | |
| 4,258,491 | A * | 3/1981 | Ernst et al. | 40/525 |
| 4,308,678 | A | 1/1982 | Slobin | |
| 4,528,933 | A | 7/1985 | Allen | |
| 4,886,010 | A | 12/1989 | Stutzmant | |
| 4,920,912 | A | 5/1990 | Kirkling | |
| 5,299,701 | A | 4/1994 | Barker | |
| 5,356,012 | A * | 10/1994 | Tang et al. | 206/534 |
| 5,377,614 | A | 1/1995 | Glazer | |
| 5,382,243 | A * | 1/1995 | Mulholland | 604/301 |
| 5,386,795 | A | 2/1995 | Bartholomew | |

(Continued)

FOREIGN PATENT DOCUMENTS

FR 2788932 2/1999

OTHER PUBLICATIONS

U.S. Appl. No. 12/491,212, Non-Final Office Action, Nov. 10, 2011.

(Continued)

*Primary Examiner* — R. A. Smith
(74) *Attorney, Agent, or Firm* — Risso & Associates

(57) ABSTRACT

Described is a medication recording device for optically enhancing the view of markings on the device. The device includes a bottle cap for connection with a prescription container. Markings indicative of at least one of a time and date are connected with the bottle cap. A prescription recording magnifier (such as a lens) is connected with the bottle cap and positioned over the markings such that the markings can be viewed through the prescription recording magnifier to optically enlarge the markings. This allows a larger portion the population with visual impairment to take advantage of new advances in home medication monitoring. Additionally, the medication recording device can be thrilled to include two lenses, where both lenses that are thrilled or shaped such that the viewing focal point of both lenses converge to a single focal point.

2 Claims, 3 Drawing Sheets

(56) References Cited

U.S. PATENT DOCUMENTS

| | | | | | |
|---|---|---|---|---|---|
| 5,433,324 | A | | 7/1995 | Leonard | |
| 5,577,335 | A | * | 11/1996 | Tucker | 40/311 |
| 5,833,068 | A | * | 11/1998 | Fantone | 206/459.1 |
| 6,000,159 | A | | 12/1999 | Hornung | |
| 6,068,149 | A | | 5/2000 | Telega | |
| 6,789,497 | B1 | | 9/2004 | Aiken | |
| D501,755 | S | | 2/2005 | Namur | |
| 7,017,762 | B2 | | 3/2006 | Shane | |
| 7,621,273 | B2 | | 11/2009 | Morton | |
| 7,661,384 | B2 | | 2/2010 | Mataya | |
| 7,857,134 | B2 | | 12/2010 | Koch | |
| 8,146,528 | B2 | | 4/2012 | Fralick | |
| 2003/0099158 | A1 | | 5/2003 | DelaHuerga | |
| 2006/0124501 | A1 | | 6/2006 | McNeely | |
| 2007/0187282 | A1 | | 8/2007 | Seijas | |
| 2014/0299504 | A1 | * | 10/2014 | Sena | 206/534 |

OTHER PUBLICATIONS

U.S. Appl. No. 12/491,212, Notice of Allowance, May 17, 2012.

* cited by examiner

MEDICATION RECORDING DEVICE

CROSS-REFERENCE TO RELATED APPLICATIONS

This is a Non-Provisional Utility Patent Application of U.S. Provisional Application No. 61/663,740, filed on Jun. 25, 2012, entitled, "Prescription Recording Magnifier."

BACKGROUND OF THE INVENTION (1) Field of Invention

The present invention is related to a prescription container and, more particularly, to a medication recording device with a prescription recording magnifier that enlarges visual markings that are used with medication reminders.

(2) Description of Related Art

Many containers have been made for tracking the intake of medications. In many instances, the bottle cap is not of sufficient size to allow for the characters (i.e., numbers and/or letters) to be of sufficient size to be easily seen.

Numerous devices have been patented and produced that allow for a medication user to view items associated with their use of medication. Examples of such devices are as follows. U.S. Patent Publication No. 2007/0187282, by Seijas, discloses a rotating dial affixed with the medication container. Alternatively, U.S. Patent Publication No 2006/0124501, by McNeely, discloses a slider rotating around the top of a medication lid. As another example, U.S. Pat. No. 5,386,795, by Bartholomew, teaches a slider moving across a medication container lid. Finally, U.S. Pat. No. 8,146,528, by Fralick, discloses a thumb wheel rotating on top of the medication lid. While operable to assist a user in identifying when to take a medication, each of these inventions have a limitation of physical size being dictated by the physical size of the container.

Such devices could be enlarged to improve visibility, however, that in turn creates additional disadvantages. Examples of such problems are as follows. For example, enlarged containers may be too large and can be clumsy to carry. Additionally, such enlarged containers require more space to store the medications and, further require more materials that must be used and discarded.

Thus, a continuing need exists for increasing the ability of a user to view relevant medication information without actually increasing the size of the medication container.

SUMMARY OF INVENTION

This invention provides a means for enlarging the visual image presented by a prescription or medication recording or reminding device. Specifically, the present invention is a medication recording device with a prescription recording magnifier that enlarges visual markings that are used with medication reminders.

The medication recording device includes a bottle cap for connection with a prescription container. Markings indicative of at least one of a time and date are connected with the bottle cap. Further, a prescription recording magnifier is connected with the bottle cap and positioned over the markings such that the markings can be viewed through the prescription recording magnifier to optically enlarge the markings.

The markings include a first set of markings formed on the bottle cap. Additionally, the prescription recording magnifier includes a first light distorting lens component. Further, a slider is rotatably connected with the bottle cap. The slider has a hole formed therethrough, with the first light distorting lens component positioned over the hole. Importantly, the slider is rotatable around the bottle cap to reveal the first set of markings through the first light distorting lens component.

In another aspect, a thumb wheel that is rotatably attached with the bottle cap. In this aspect, the markings also include a second set of markings formed on the thumb wheel. Additionally and in this aspect, the prescription recording magnifier includes a second light distorting lens component attached with the bottle cap such that it is positioned over the second set of markings, whereby a user can rotate the thumb wheel to reveal the second set of markings through the second light distorting lens component.

In another aspect, the first and second light distorting lens components are each lenses (e.g., convex lenses) that are shaped or positioned such that the viewing focal point of both lenses converge to a single focal point.

Finally, as can be appreciated by one in the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

Figure 1:
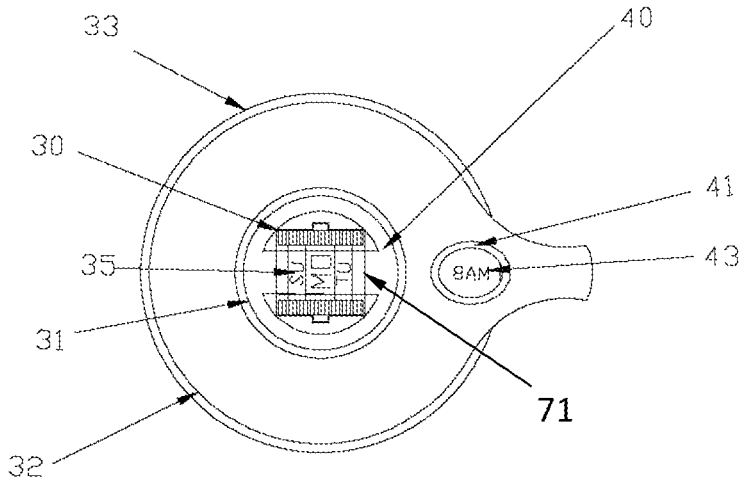
FIG. 1 is a top-view illustration of a medication recording device, depicting visual enhancing lenses attached to time keeping components.

The present invention is related to a prescription container and, more particularly, to a medication recording device with a prescription recording magnifier that enlarges visual markings that are used with medication reminders. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward. reverse, clockwise and counter clockwise have been used for convenience purposes only and are not intended to imply any particular fixed direction. Instead, they are used to reflect relative locations and/or directions between various portions of an object.

(1) Description

The present invention is directed to a prescription recording magnifier that enhances existing prescription recording and monitoring devices affixed to prescription bottles. As noted above, existing prescription or medication containers are not of sufficient size to allow for the characters (i.e., numbers and/or letters) to be easily seen. Thus, the present invention improves upon the prior art by providing an improved visual display through the addition of a convex lens (or set of lenses) to the mechanics of the medication recording device. In doing so, the present invention provides a device for enlarging the visual image presented by a prescription or medication recording or reminding device. It should be noted that the prescription recording magnifier can be applied to any medication recording or reminding device, a non-limiting example of which includes the device of U.S. Pat. No. 8,146,528, by Fralick, which is hereby incorporated by reference as though fully set forth herein.

Thus, the present invention is a medication recording device that includes a prescription recording magnifier for enlarging the visual image presented by such a prescription or medication recording device. At its most basic level, the medication recording device includes a bottle cap with markings (or an image) that indicate a date, time, etc. at which the relevant medication should be taken. The markings are either repositionable and/or a repositionable viewing window is movably attached with the bottle cap to allow for selective positioning of the viewing window over the markings. The prescription recording magnifier (i.e., lens) is positioned over the markings to optically enlarge the markings. As can be understood by those skilled in the art, there are numerous techniques by which such a medication recording device can be accomplished, a non-limiting example of which is illustrated in FIGS. 1 through 4 and described in further detail below.

FIG. 1 provides a top-view illustration of a medication recording device with such a prescription recording magnifier. In this example, the medication recording device includes a rotating slider 32 that is rotatably connected with a bottle cap 33 and that can be rotated around the bottle cap 33 to the select the desired time (as illustrated). In other words, below the rotating slider 32 and on top of the bottle cap 33 are markings 43 (such as time stamps) that run around the top (depicted as element 34 in FIG. 2) of the bottle cap 33. The rotating slider 32 includes a hole (i.e., viewing window) formed therethrough that allows a user to view a particular marking 43 (i.e., time stamp) through the hole. A first light distorting lens component 41 is attached (i.e., glued or affixed using any suitable mechanism, technique, or device) with the rotating slider 32 such that it is positioned over the hole to allow a user to view the markings below the rotating slider 32 and through the hole. Importantly, the first light distorting lens component 41 is a lens (e.g., clear lens) that is shaped to distort light and visually enlarge the marking 43 on the bottle cap 33 for the user. It should be noted that the term bottle cap 33 is intended to refer to any cap or lid that can be attached with a medication or prescription container.

Also depicted in FIG. 1 is thumb wheel 30 that is positioned within the center of the bottle cap 33, the slider 32, and a thumb wheel retainer 31. The thumb wheel retainer 31 is attached with the bottle cap 33 and formed to rotatably hold the thumb wheel 30. Additionally, the thumb wheel 30 includes a number of markings 35 (a non-limiting example of which includes day stamps) formed around the thumb wheel 30 to allow a user to rotate the thumb wheel 30 to illustrate the desired marking 35. Thus, the thumb wheel 30 is rotatably attached with the bottle cap 33 such that the thumb wheel can be rotated to reveal a marking 35 indicative of at least one of a time and date. Notably, the rotating slider 32 is rotatable on an X-axis and the thumb wheel 30 is rotatable on a Y-axis.

A second light distorting lens component 40 is mounted on top of the thumb wheel retainer 31. The second light distorting lens component 40 is a lens (e.g., clear lens) that is shaped to distort light and visually enlarge the marking 35 on the thumb wheel 30. For example, when viewing the bottle cap 33 from above, the markings 35 on the thumb wheel 30 are visually distorted by the shape of the lens through which light passes to enlarge the day (in this non-limiting example) written on the thumb wheel 30.

Figure 2:
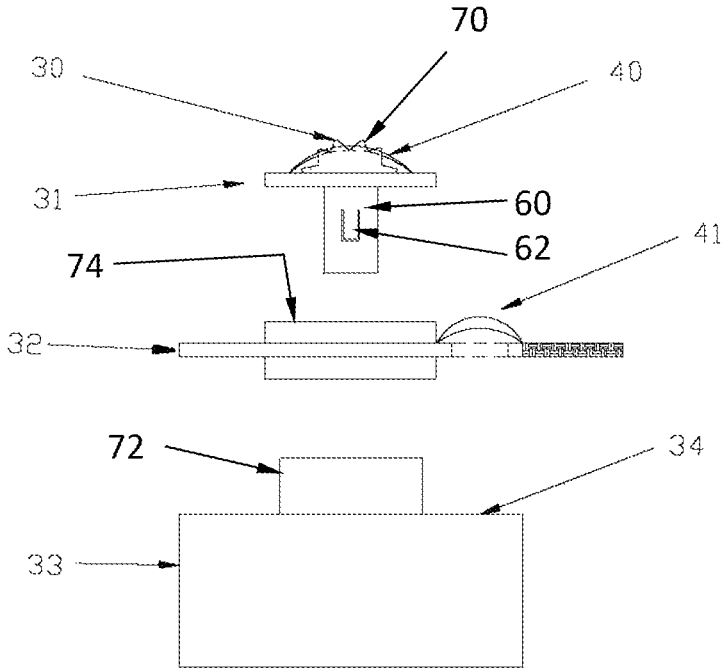
FIG. 2 is a side-view illustration of the medication recording device, depicting the visual enhancing lenses attached to time keeping components.

For further understanding, FIG. 2 provides a side-view illustration of a medication recording device having the magnifiers incorporated therein. As shown, the slider 32 has a hole 74 that allows it to be positioned around a protrusion 72 (e.g., cylindrical protrusion) that is formed on top of the bottle cap 33. Thus, the slider 32 can be rotated around the protrusion 72 on the bottle cap 33 to select the desired time (as illustrated in FIG. 1). As was also noted above, the shape of the first light distorting lens component 41 distorts light and visually enlarges markings that are on top 34 of the bottle cap 33.

Also as depicted is the thumb wheel 30 positioned within the center of the bottle cap 33, the slider 32, and the thumb wheel retainer 31. A clear lens (i.e., the second light distorting lens component 40) is mounted (i.e., glued or affixed using any suitable mechanism, technique, or device) on the thumb wheel retainer 31 such that the lens covers a central portion of the thumb wheel 31 that includes relevant markings (depicted as element 35 in FIG. 1). It should be noted that the second light distorting lens component 40 is formed to allow gripping elements 70 of the thumb wheel 30 to extend above and beyond the second light distorting lens component 40. In other words and as shown between FIGS. 1 and 2, the thumb wheel 30 includes gripping elements 70 that allow a user to rotate the thumb wheel 30. Between the gripping elements 70 is a central portion 71 (as shown in FIG. 1) of the thumb wheel 30 that includes the markings 35. The central portion 71 is sunken or otherwise below a level of the gripping elements 70 that straddle the central portion. Thus, the second light distorting lens component 40 is formed such that it covers this central portion 71, yet allows the gripping elements 70 to protrude beyond the second light distorting lens component 40. It should also be noted that although FIG. 2 illustrates the thumb wheel 30 as having gripping elements 70 above the wheel retainer 31, the thumb wheel 30, in actuality, has gripping elements 70 that extend all the way around the thumb wheel 30 to allow for ease of rotation of the thumb wheel 30.

It should also be noted that the thumb wheel 30 is affixed with the bottle cap 33 using any suitable mechanism or device. As a non-limiting example, the thumb wheel retainer 31 includes a protrusion 60 with tabs 62. Thus, in this example, the protrusion 60 can be positioned through the hole 74 of the slider 32 and into the cylindrical protrusion 72 that is formed on top of the bottle cap 33. The tabs 62 engage with corresponding markings within the cylindrical protrusion 72 to affix the wheel retainer 31 against the bottle cap 33.

When viewing the bottle cap 33 from above, markings 35 (e.g., day markings, etc.) on the thumb wheel 30 are visually distorted by the shape of lens through which light passes to enlarge the day markings 35 (in this case) written on the thumb wheel 30

Figure 3:
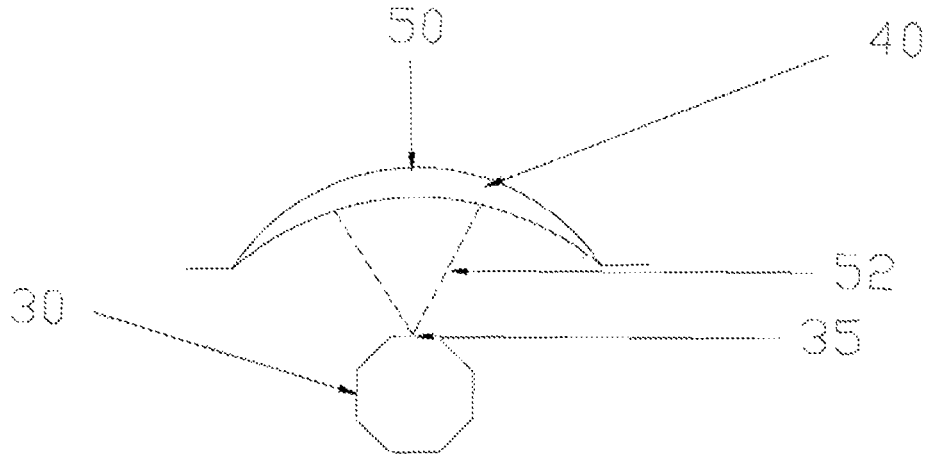
FIG. 3 is a side-view illustration of a convex lens, depicting an example relationship of a convex lens (in this example) on the viewing ability of a thumb wheel illustrating numbers, letters, time/s and/or date/s.

FIG. 3 provides an exposed, side-view illustration of the components required for operation of the optical lens (i.e., the second light distorting lens component 40) modification of a prescription recording device. The second light distorting lens component 40 is visually clear to the eye when viewed from position 50. The shape of the lens (as is well known by those skilled in the art) focuses light 52 onto a small portion of the thumb wheel 30 that includes the markings 35 displayed in earlier figures.

Figure 4:
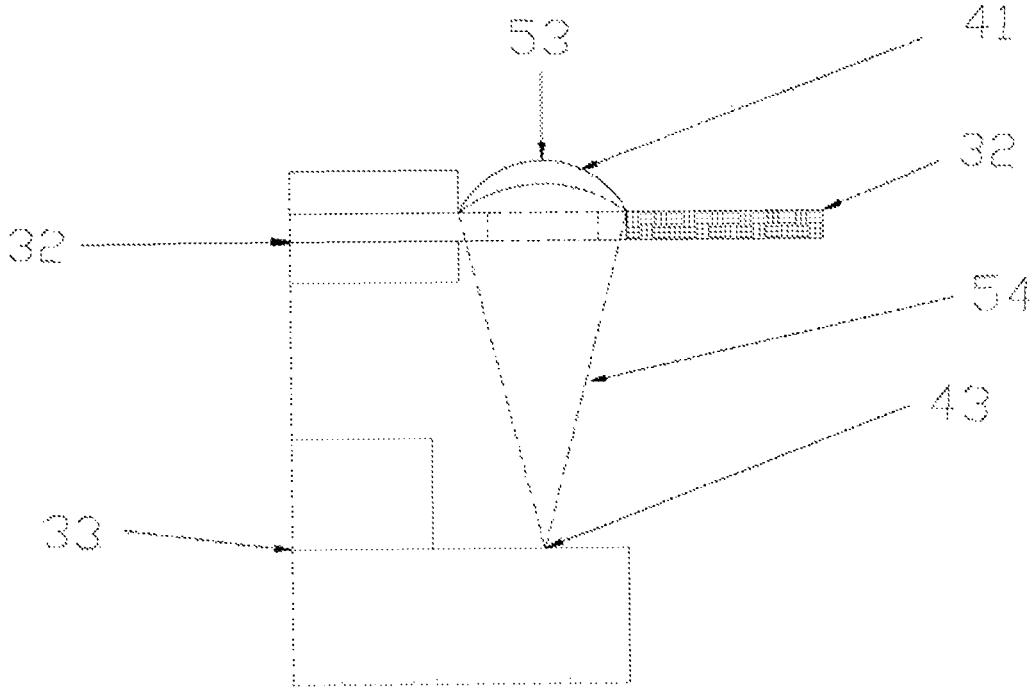
FIG. 4 is a side-view illustration of a convex lens (in this example), depicting an example relationship of a convex lens on the viewing ability of a rotating slider that illustrates numbers, letters, time/s and/or date/s.

FIG. 4 provides an exposed, side view illustration of the components required for operation of the optical lens (i.e., first light distorting lens component 41) modification of the prescription recording device. As was the case above, the first second light distorting lens component 41 is visually clear to the eye when viewed from position 53. The shape of the lens (as is well known by those skilled in the art) focuses light 54 onto a small portion of the bottle cap 33 that includes the markings 43 displayed in earlier figures.

Thus, both the first 41 and second 40 light distorting lens components are lenses that are shaped in any suitable manner such that the lenses appear to visually enlarge markings positioned below the lenses. As a non-limiting example, the lenses are convex lenses.

Figure 5:
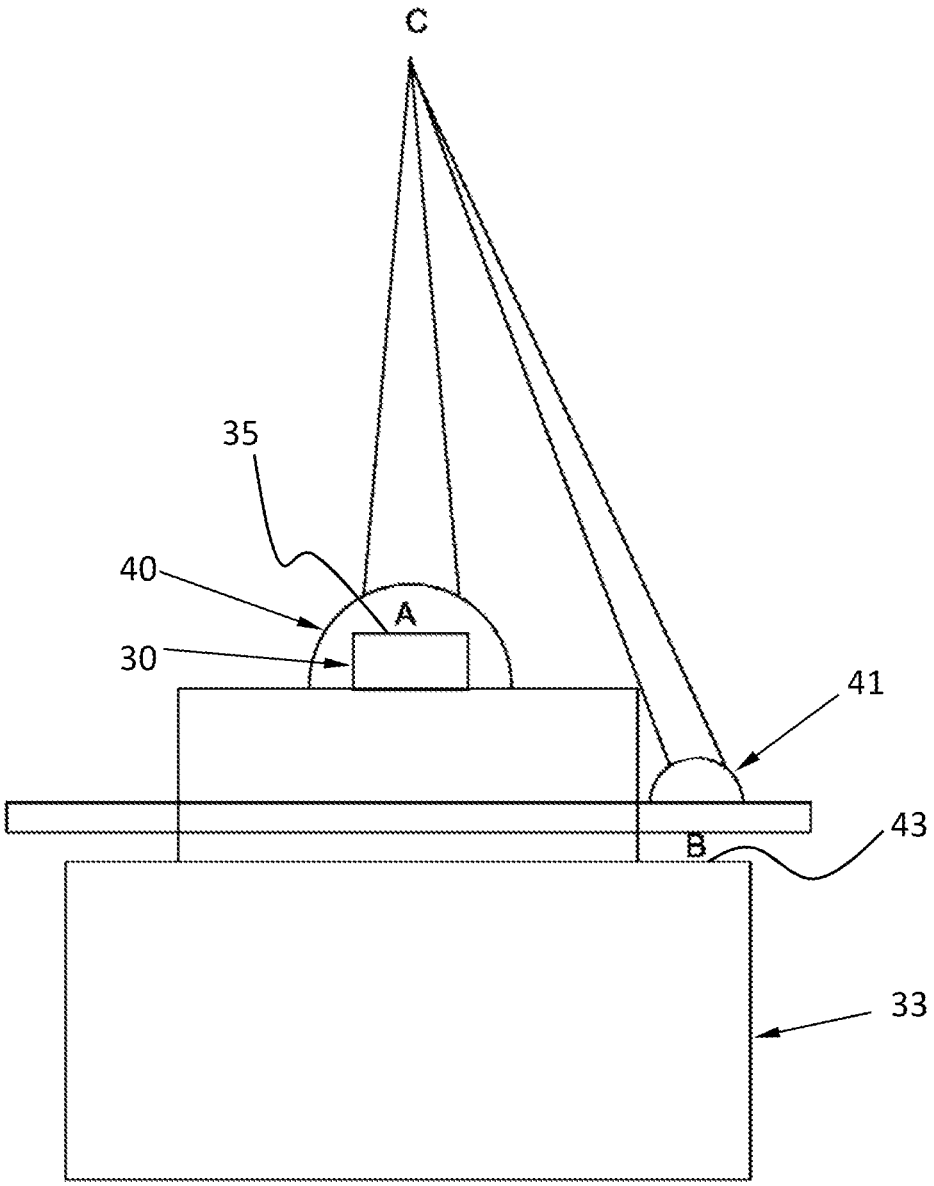
FIG. 5 is a side-view illustration depicting how the lenses positioned near both the thumb wheel and rotating slider are formed or otherwise positioned to provide a single, convergent, viewing focal point for both lenses so that the medication recording device can be read with ease from one point.

In another aspect and as depicted in FIG. 5, both convex lenses can be arranged in such a manner (such as formed, shaped or positioned) as to maintain a single focal point (e.g., directly above the thumb wheel) while enlarging each of their individual markings. This is to be contrasted with two lenses both having perpendicular viewing locations directly above the markings and two focal points. Thus, in this aspect, the lenses are positioned or formed such that they have a single focal point for both lenses so that the medication recording device can be read with ease from a single point. As a non-limiting example, at least one of the lenses is tilted a little so that its focal point converges with the other. As another non-limiting example, the lens is formed to have a shape such that the focal points of the two lenses converge.

For example and as shown in FIG. 5, the markings 35 and 43 that are to he viewed are at locations A and B, respectively. Importantly, the markings 35 and 43 are to he viewed from focal point C through the lenses 40 and 41 (i.e., the light distorting lens components (e.g., convex lenses)). A typical magnification lens provides a viewing point that is perpendicular to the text. Thus, in using two lenses, there would typically be two focal points. However, in the aspect as depicted in FIG. 5, the lenses are shaped and/or positioned (using techniques as commonly known by those skilled in the art of lenses) such that the viewing focal point of both lenses 40 and 41 converge to a single focal point C. As a non-limiting example, the lenses 40 and 41 are formed such that the focal point C for both lenses converge above and in the center of the bottle cap 33. Thus, in this example, the convex lenses 40 and 41 are arranged in such a manner as to maintain a single focal point C directly above the thumb wheel 30 while enlarging each of their individual markings, 35 and 43, respectively. As such, the lenses operate as magnifiers for the markings 35 and 43 that are affixed with medication recording device.

Stated in another manner, the medication recording device includes two sets of markings, a first set of markings 43 and a second set of markings 35. A prescription recording magnifier includes two lenses, a first lens 41 positioned above the first set of markings 43 and a second lens 40 positioned above the second set of markings 35. Importantly, the first and second lenses 40 and 41 are formed or shaped such that the viewing focal point of both lenses converge to a single focal point (element C).

In summary, the present invention is a medication recording device that includes a prescription recording magnifier for enlarging the visual image presented by such a prescription or medication recording device. The prescription recording, magnifier is one or more lenses (i.e., light distorting lens components) that can be positioned or otherwise affixed with a medication recording device at any desired location. Several non-limiting examples of suitable locations include being positioned over (1) a slider mechanism to reveal any single or combination of visually enhanced numbers, letters, time/s and/or date/s through the viewing portal; (2) thumb wheels to more clearly reveal any combination of visually enhanced numbers, letters, time/s and/or date/s; and (3) a digital device to reveal any single or combination of visually enhanced numbers, letters, time/s and/or date/s. Further, the lenses can be formed and/or positioned such that they share a single viewing focal point.

What is claimed is:

1. A medication recording device, comprising:

a bottle cap for connection with a prescription container:

wherein markings indicative of at least one of a time and date are connected with the bottle cap;

a prescription recording magnifier connected with the bottle cap and positioned over the markings such that the markings can be viewed through the prescription recording magnifier to optically enlarge the markings;

wherein the markings include a first set of markings formed on the bottle cap;

wherein the prescription recording magnifier includes a first light distorting lens component;

a slider rotatably connected with the bottle cap, the slider having a hole formed therethrough, with the first light distorting lens component positioned over the hole; and wherein the slider is rotatable around the bottle cap to reveal the first set of markings through the first light distorting lens component;

a thumb wheel that is rotatably attached with the bottle cap;

wherein the markings include a second set of markings formed on the thumb wheel;

wherein the prescription recording magnifier includes a second light distorting lens component attached with the bottle cap such that it is positioned over the second set of markings, whereby a user can rotate the thumb wheel to reveal the second set of markings through the second light distorting lens component; and wherein the first and second light distorting lens components are each lenses that are shaped or positioned such that the viewing focal point of both lenses converge to a single focal point.

2. A medication recording device, comprising:

a bottle cap for connection with a prescription container, the bottle cap having a first set of markings;

a slider rotatably connected with the bottle cap, the slider having a hole formed therethrough, with a first lens positioned over the hole, the slider being rotatable around the bottle cap to reveal the first set of markings through the first lens;

a thumb wheel that is rotatably attached with the bottle cap, the thumb heel having a second set of markings;

a second lens attached with the bottle cap such that it is positioned over the second set of markings, whereby a user can rotate the thumb wheel to reveal the second set of markings through the second lens; and wherein the first and second lenses are shaped or positioned such that the viewing focal point of both lenses converge to a single focal point.

* * * * *